United States Patent [19]

Dziedzic

[11] Patent Number: 4,679,526

[45] Date of Patent: Jul. 14, 1987

[54] WORKPIECE HOLDER FOR COATING PROCESSES

[75] Inventor: Jerome J. Dziedzic, Greenfield, Wis.

[73] Assignee: Flur Wire & Metal Inc., Oak Creek, Wis.

[21] Appl. No.: 891,163

[22] Filed: Jul. 31, 1986

[51] Int. Cl.[4] ..... B05C 13/02

[52] U.S. Cl. ..... 118/503; 204/297 R; 204/297 W

[58] Field of Search ..... 118/503; 204/297 R, 204/297 W

[56] References Cited

U.S. PATENT DOCUMENTS

| | | | |
|---|---|---|---|
| 2,512,554 | 6/1956 | Schneider | 204/297 W |
| 2,904,492 | 9/1959 | Nalt | 204/297 W |
| 4,037,727 | 7/1977 | Kunkle | 204/297 W |

*Primary Examiner*—John P. McIntosh

*Attorney, Agent, or Firm*—James E. Nilles; James R. Custin

[57] ABSTRACT

A holder for workpieces to be coated is bent from a single piece of stiff but springy wire. A medial portion of the piece of wire defines two clamping arms that are connected at their front ends by a spring coil; and one end portion of the wire defines a mounting portion in the form of a loop connected to the rear end of one clamping arm; and the other end portion of the wire defines a pair of stabilizing wings, one of which is U-shaped with legs respectively connected to the rear end of the other clamping arm and to the other stabilizing wing. The holder is detachably connected to a carrier by means of a U-shaped supporting member having apertured lugs projecting forward from a central body. Opposite portions of the loop project through the apertures in the lugs.

5 Claims, 6 Drawing Figures

WORKPIECE HOLDER FOR COATING PROCESSES

FIELD OF THE INVENTION

This invention relates to holders whereby workpieces that are to be coated at a coating station are removably attached to a carrier such as a chain conveyor that transports the workpieces along a path through the coating station; and the invention is more particularly concerned with a simple and inexpensive workpiece holder which can be securely but readily removably attached to a carrier and which is so arranged that workpieces can be quickly and easily attached to it and removed from it but workpieces on it are nevertheless securely clampingly held by it and are maintained in a predetermined attitude favorable for the operation performed at the coating station.

BACKGROUND OF THE PRIOR ART

Coating processes in which holders line those of the present invention are used include dipping processes in which liquid paints and other coatings are applied to workpieces by immersion, and also fluidized bed coating, spray painting, electroplating and anodizing processes.

Where numerous substantially identical workpieces are to be subjected to such a process, the workpieces are usually transported to, through and away from the coating station on a carrier such as a chain conveyor that is equipped with numerous workpiece holders arranged at intervals along its length. A workpiece is loaded onto each holder at a loading station ahead of the coating station and is removed from the holder at an unloading station down-line from the coating station. Loading and unloading are usually manual operations, and therefore the holders that support the workpieces must be so configured that those operations can be performed very quickly and easily by persons having minimal skill and dexterity.

The holders heretofore used for connecting workpieces to the carrier have usually been formed as a hook or loop bent from a single piece of relatively stiff wire. The low cost of such holders was an important consideration because a workpiece holder tends to become coated after carrying one or a few workpieces through the coating station and must then be removed from the carrier, discarded and replaced with a new one. Obviously it is also important that the holder be arranged for quick and easy installation on the carrier and removal from it.

A type of holder heretofore used for many coating operations, and especially for those involving apertured workpieces, was essentially in the form of a simple hook having an eye or loop at its top by which it was hung on a carrier and having a bowed bottom that projected through an aperture in the workpiece. In some cases the holder was arranged to support a number of workpieces and was in the form of a wire rack or frame having a number of hooks for supporting workpieces in spaced apart relation to one another and having a pair of hooks at its top that provided for attachment of the holder to a carrier.

Such prior holders have been satisfactory in most respects, but they have had some defects and disadvantages which have apparently been accepted as inevitable in the sense that there was no obvious way to overcome or avoid them without sacrificing the important characteristics of low cost, quick and easy loading and unloading, and quick and easy installation on the carrier and removal from it.

A major defect of many prior holders was that they provided only single-point support for each workpiece, so that the workpiece was free for at least a limited amount of turning and swinging. As a result, there was no assurance that the workpiece would enter and pass through the coating station in an optimum attitude such that it would assuredly receive an even and uniform coating. In some cases, particularly where the workpiece was immersed in a liquid bath at the coating station, the workpiece tended to float off of the holder at that station as its surface encountered the surface of the liquid in which it was to be dipped.

To some extent these disadvantages could be overcome if the workpiece had two or more apertures, since the holder could then be in the form of a rack having a pair of hooks, one for each of two apertures in the workpiece. In such cases, however, loading of workpieces onto the holders tended to be complicated and slowed by the need for manipulating each workpiece to bring first one of its apertures and then the other into alignment with the respective holder hooks intended for them.

An important disadvantage common to all such prior holders was apparent when they were employed in a coating process which required each workpiece to be connected in an electrical circuit, as in an electroplating process or an electrostatic spray painting process. In such cases the holder was relied upon to connect the workpiece in the electrical circuit, but the electrical connection between the holder and the workpiece was a somewhat unreliable one that tended to offer a high resistance to current flow inasmuch as the hook or hooks of the holder had only limited point contact with the workpiece and bore against it with a force that depended upon the weight of the workpiece.

SUMMARY OF THE INVENTION

The general object of the present invention is to provide a very simple and inexpensive workpiece holder which is readily removably attachable to a carrier and to which a workpiece is in turn attachable for transport by the carrier to, through and away from a coating station, said holder being so configured that it can be loaded and unloaded as quickly and easily as a heretofore conventional hook-like holder but that it nevertheless clampingly engages the workpiece, confining it against accidental detachment, maintaining it in a predetermined attitude favorable to the operation conducted at the coating station, and providing for a positive low resistance connection of the workpiece into an electrical circuit.

Another and more specific object of the invention is to provide a workpiece holder of the character described, having workpiece engaging portions that securely clampingly engage and stabilize a workpiece and a mounting portion by which the holder can be quickly and easily fastened securely but readily detachably to a very simple and inexpensive supporting member that connects the holder with a carrier such as a chain conveyor, said holder being inexpensive enough to be discarded and replaced whenever necessary by reason of its comprising a single piece of wire and being suitable for forming by means of an automatic machine that bends the wire to provide said workpiece engaging portions and mounting portion.

Another specific object of the invention is to provide a workpiece holder of the character described and a very simple and inexpensive one-piece supporting member which cooperates with the mounting portion of the holder to provide a secure and rigid but readily detachable connection between the holder and a carrier such as a chain conveyor, said supporting member being adapted for attachment to a carrier in any of a variety of ways so as to be suitable for practically any type of carrier installation.

These and other objects of the invention that will appear as the description proceeds are achieved in the workpiece holder of this invention, which is detachably secureable to a carrier such as a chain conveyor and to which a workpiece to be coated is quickly and readily removably secureable for transport by the carrier along a path that carries the workpiece through a coating station. The workpiece holder of this invention comprises a single piece of substantially stiff but springy wire having a pair of opposite ends. Characterizing features of the invention reside in the configuration to which said piece of wire is bent. Specifically, a medial portion of said piece of wire is bent to define a pair of clamping arms connected by a spring coil, said clamping arms and spring coil being substantially contained in a single plane, each of said clamping arms having a front end adjacent to said spring coil and a rear end spaced to the rear of the spring coil and spaced from the rear end of the other clamping arm, and each of said clamping arms having an undulation intermediate its said ends, said undulations defining opposing concavities in which opposite edge portions of a workpiece are receivable for confinement of the workpiece under clamping bias imposed upon the clamping arms by the spring coil. One end portion of the piece of wire is bent to define a loop connected to one of said clamping arms at the rear end thereof and substantially all portions of which are coplanar, said loop providing for securement of the holder to a carrier with said one clamping arm projecting in a predetermined direction from the carrier. The other end portion of said wire is bent to define a pair of stabilizing wings, each of which has an inner end and an outer end, the inner end of each stabilizing wing being adjacent to the rear end of the other of said clamping arms and the outer ends of the stabilizing wings being spaced to opposite sides of said plane and in forwardly offset relation to said rear end of the other clamping arm, one of said stabilizing wings being substantially U-shaped with a bight portion at its outer end and a pair of elongated legs which are connected by said bight portion, one of said legs being connected at its inner end with the rear end of said other clamping arm, and the other of said stabilizing wings being connected at its inner end with the inner end of the other of said legs.

The supporting member by which the workpiece holder is detachably securable to a carrier can be formed from a single piece of metal having a body portion with a pair of opposite edges and with a substantially flat surface between those edges that faces forwardly and is overlain by a major portion of said loop. Projecting in said forward direction from each of said edges is a lug that has an aperture. Opposite portions of said loop project beyond the body portion through said apertures and have a close slidable but frictional fit in said apertures.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENTS OF THE INVENTION

Figure 1:
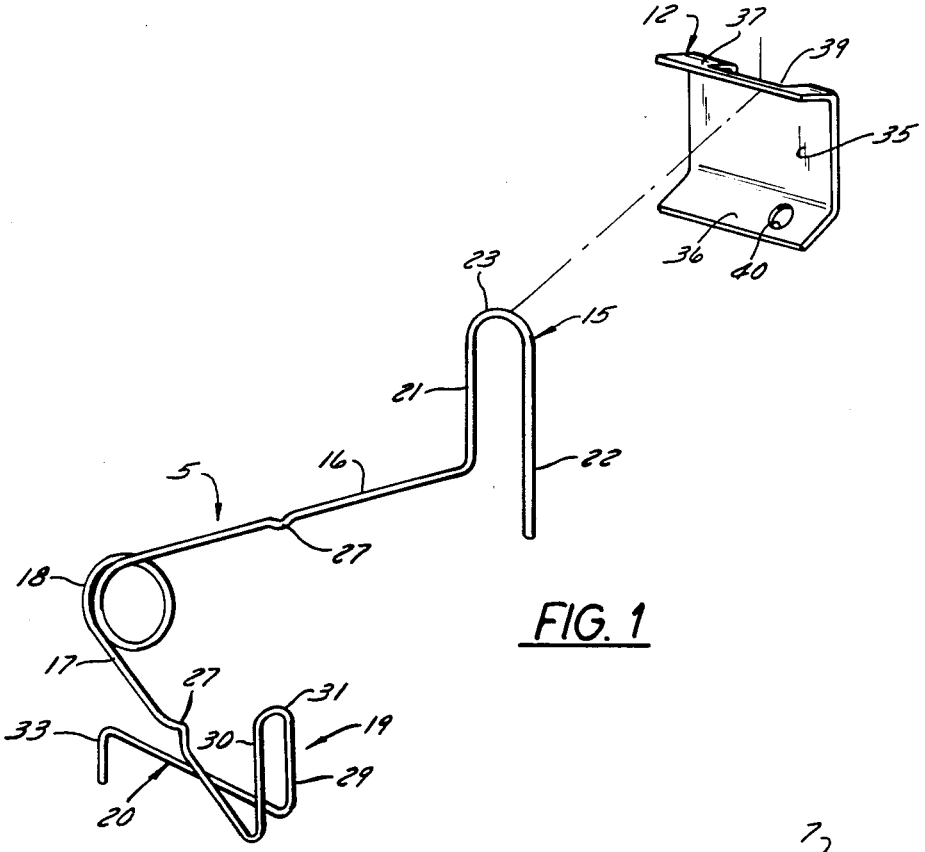
FIG. 1 is a perspective view of a workpiece holder of this invention, in detached relationship to a supporting member by which the workpiece holder is connectable to a carrier.

A workpiece holder 5 embodying the principles of this invention provides a temporary connection between a workpiece 6 and a carrier 7 whereby the carrier can transport the workpiece along a defined path. In the usual case the workpiece 6 is manually loaded onto the holder 5 at a loading station, is moved by the carrier through a coating or plating station, and is manually removed from the holder at an unloading station, from which the carrier brings the empty holder back to the loading station to be loaded with a new workpiece. The stations and the carrier 7 are very familiar to those acquainted with production plating and coating processes, and therefore the stations are not shown and the carrier, which is here illustrated as a chain conveyor, is not shown completely nor in detail.

In the usual installation workpiece holders 5 are secured to the carrier 7 at more or less regularly spaced intervals along its length. In some cases, especially where the workpieces are small in relation to the dip bath or spray chamber at the coating station, two or more holders may be secured to the carrier at each of a number of regularly spaced locations along the carrier, the several workpiece holders 5 at each such location being attached to a generally conventional frame-like rack (not shown) which provides for connection of the holders to the carrier.

A workpiece holder 5 that embodies the principles of this invention is formed from a single piece of substantially stiff but springy wire. A supporting member 12, which can be formed as a very simple stamping, provides for attachment of the workpiece holder 5 to a carrier.

The single piece of wire that comprises the workpiece holder 5 is bent to define three main parts of that holder, namely a rear mounting portion 15 which provides for securement of the workpiece holder to a supporting member 12, a clamping portion which comprises a pair of clamping arms 16 and 17 that are connected by a spring coil 18, and a pair of stabilizing wings 19, 20 that serve to maintain a workpiece on the holder in a predetermined attitude.

The rear mounting portion 15 of the workpiece holder, which is formed from one end portion of the piece of wire, is bent into a loop that has substantially all of its portions contained in a single plane. As here shown and as is preferred, the mounting portion 15 is U-shaped, having a pair of legs 21 and 22 that are substantially parallel to one another and a bight portion 23 that connects the legs. At its end remote from the bight portion 23 one leg 21 is connected to a rear end of one of the clamping arms 16, while the other leg 22, which terminates at an end of the piece of wire, is somewhat longer than the leg 21, for reasons explained below.

The clamping arm 16 that is directly connected to the shorter leg 21 of the mounting portion loop can project from the plane of that loop in any desired direction, depending upon the attitude in which the workpiece is to be transported and the orientation of the supporting member 12, but preferably that clamping arm 16 is perpendicular or nearly perpendicular to the plane of the mounting portion 15. The spring coil 18, which is continuous with the clamping arm 16 at the front end thereof, comprises at least one full turn of the wire and continues on into the front end of the other clamping arm 17. The two clamping arms 16 and 17 and the spring coil 18 that connects them are substantially contained in a single fore-and-aft extending plane that is substantially perpendicular to the plane containing the mounting portion 15. The clamping arm 17, which is preferably somewhat shorter than the clamping arm 16, projects from the spring coil 18 in rearwardly divergent relation to the clamping arm 16, so that the two clamping arms define an acute angle which has its apex near the front of the spring coil. The rear end of the clamping arm 17 is thus spaced to the rear of the spring coil 18 and spaced laterally from the rear end of the clamping arm 16.

Figure 3:
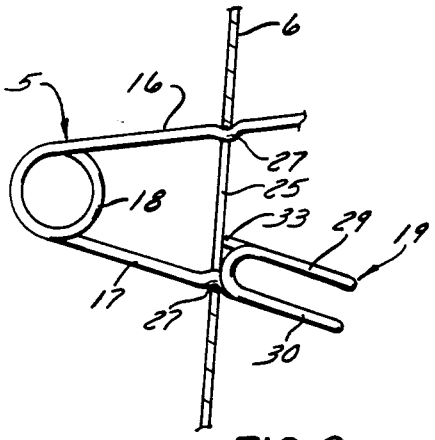
FIG. 3 is a fragmentary view in side elevation of the workpiece holder carrying an apertured workpiece.
Figure 2:
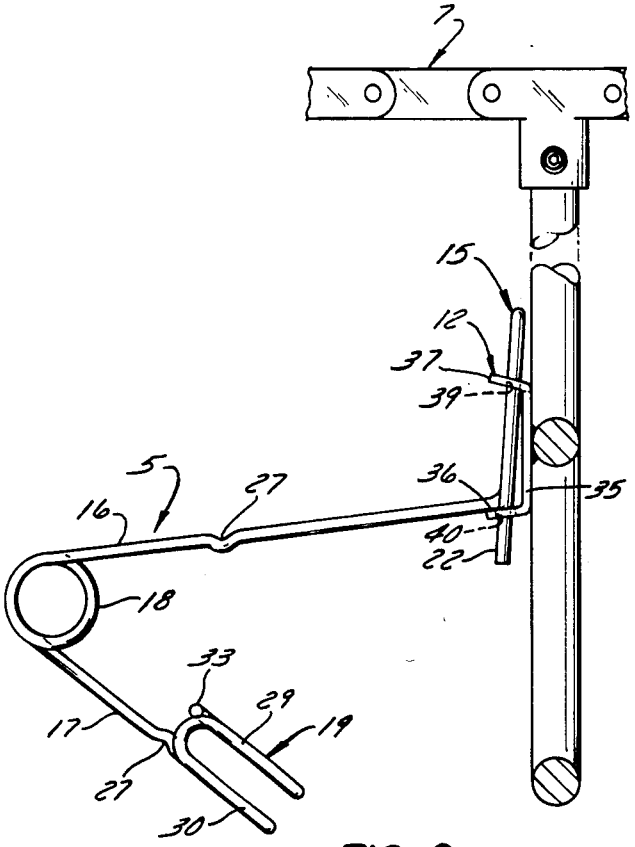
FIG. 2 is a view in side elevation of the workpiece holder connected to a supporting member.
Figure 4:
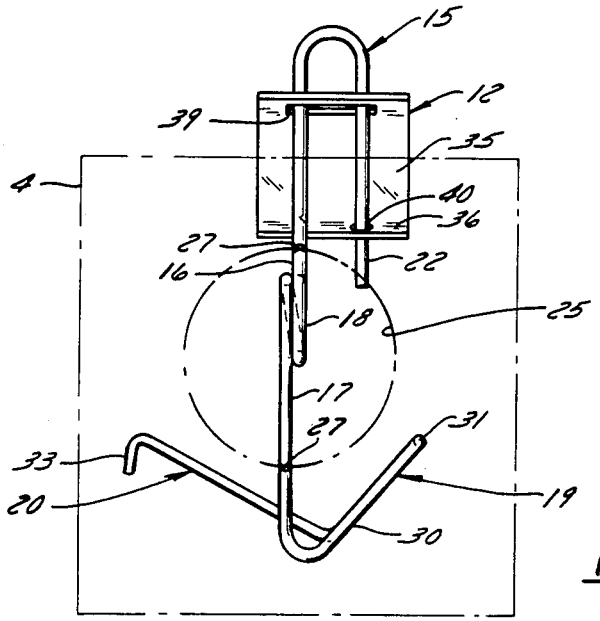
FIG. 4 is a view in front elevation of the workpiece holder secured to the supporting member and carrying an apertured workpiece.
Figure 6:
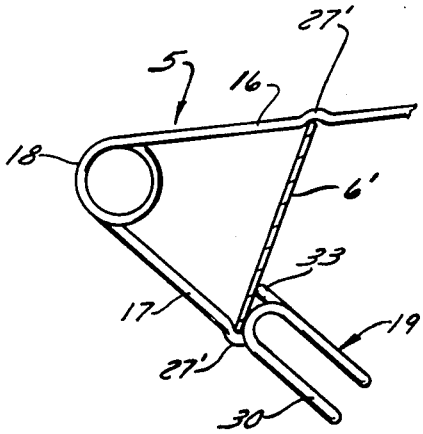
FIG. 6 is a view generally similar to FIG. 3 but illustrating a modified form of the workpiece holder that is suitable for unapertured workpieces.

The rear ends of the two clamping arms 16, 17 can be flexed towards one another or away from one another against a fairly stiff bias that is imposed upon them by the spring coil 18. Such bias enables them to have clamping engagement with a pair of opposite edge portions of a workpiece 5. Where the workpiece 6 has a hole 25 therethrough, as will often be the case, the workpiece is installed on the holder with the clamping arms 16, 17 partway projecting through the hole and engaging diametrically opposite edge portions of the hole under divergent clamping bias as shown in FIG. 3; whereas if the workpiece 6' is unapertured it is confined between the arms, which engage a pair of opposite side edge portions of the workpiece under convergent clamping bias as shown in FIG. 6. To provide for a detent-like engagement of the clamping arms with a workpiece, each of the arms 16, 17 is slightly bent at a location intermediate its ends to provide a small undulation 27 in it. The undulations in the two arms are preferably at like distances to the rear of the spring coil 18 and they define opposing concavities in which the opposite edge portions of a workpiece are received to confine the workpiece against being slidingly displaced along the arms in response to the oblique clamping force which the arms exert upon it. Thus if the clamping holder is intended for engagement in a hole in an apertured workpiece (FIG. 3), the undulation 27 in each arm 16, 17 defines a concavity in the arm that opens away from the other arm 17, 16; whereas if the holder is intended for an unapertured workpiece that is to be confined between the arms (FIG. 6), each undulation 27' defines a concavity that opens towards the other arm. It will be understood that the distance between the undulations 27 in the respective clamping arms is so designed that the arms are flexed slightly into appropriate clamping bias by their engagement with a workpiece. Accordingly, the parameters of the workpiece holder must be designed to suit the parameters of the workpiece to some extent, although the resilience of the holder accommodates a considerable range of variation in workpiece parameters so that each holder can cooperate with a variety of workpieces.

Figure 5:
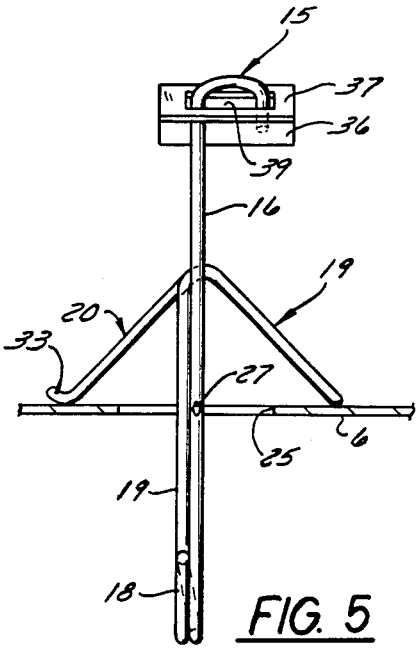
FIG. 5 is a top view of the workpiece holder, supporting member and workpiece shown in FIG. 4.

The stabilizing wings 19 and 20 have inner ends adjacent to the rear end of the clamping arm 17 and project laterally to opposite sides of the plane that contains the clamping arms 16, 17 and the spring coil 18. As best seen in FIG. 5, the stabilizing wings project obliquely laterally and forwardly to have their outer ends in forwardly offset relation to their inner ends, so that their outer ends cooperate with the undulations 27 in the clamping arms to confine a workpiece 6 in a predetermined attitude wherein a rear surface of the workpiece is substantially normal to the plane just mentioned. For that purpose the outer ends or tip portions of the stabilizing wings 19, 20 engage the rear surface of the workpiece at opposite sides of a line connecting the two undulations 27 and under a light flexing bias to make firm contact with the workpiece.

As pointed out above, the rear mounting portion 15 of the clamping holder comprises one end portion of the single piece of wire from which the clamping holder is formed and is continuous with the rear end of the longer clamping arm 16. The stabilizing wings 19, 20 are formed from the other end portion of that piece of wire and are continuous with the rear end portion of the other clamping arm 17 as well as being continuous with one another.

One stabilizing wing 19 is substantially U-shaped, having a pair of substantially parallel legs 29, 30 that are connected by a bight portion 31 at the tip of that stabilizing wing 19 that provides a rounded surface on it for engagement against a workpiece. One leg 29 of this U-shaped stabilizing wing 19 has its inner end connected to the rear end of the clamping arm 17; the other leg 30 has its inner end connected to the inner end of the other stabilizing wing 20, which projects from the U-shaped wing 19 at approximately right angles to it. Preferably the singleleg stabilizing wing 20 has its tip portion curved rearwardly, as at 33, to provide it with a rounded workpiece engaging surface.

The mounting member 12 by which each workpiece holder 5 is secured to a carrier can be formed in one piece, stamped from an initially flat piece of stiff sheet metal to be bent to substantially a U-shape, with a rectangular body or central portion 35 that has a flat front surface and with a wide lug 36, 37 projecting forwardly from each of a pair of opposite edges of the body portion. The lugs 36, 37 and the body portion 35 have a width substantially greater than the distance between the two legs 21, 22 of the U-shaped rear mounting portion 15 of the workpiece holder; and the distance between the lugs 36 and 37 is substantially less than the length of the shorter one 21 of those two legs.

The lugs 36 and 37 are apertured so that opposite portions of the loop that comprises the mounting portion 15 of the holder can project through those lugs while a major portion of that loop is confined against the flat front surface of the supporting member body portion. In this case the lug 37 has a slot 39 through which the bight portion of the mounting portion loop projects and which has a rear edge that extends along the flat front surface of the mounting member body portion; and the other lug 36 has a hole 40 through which the longer leg 22 of the mounting portion loop projects. The slot 39 and the hole 40 are so dimensioned that the mounting portion 15 of the workpiece holder is engaged with them under some degree of lengthwise sliding friction that prevents inadvertent displacement of that holder out of the supporting member but permits it to be installed and removed with the exertion of a reasonable sliding force.

The supporting member 12 can be secured to the carrier in any desired manner, as for example by means of a weldment to the rear surface of its body 35, a screw through its body or the like; and of course it can be fastened either directly to the carrier or to a rack or the like which carries a number of supporting members and which is hooked or otherwise fastened to a carrier.

Because the clamping arms 16, 17 of the workpiece holder are rather firmly maintained in a predetermined orientation, an apertured workpiece is very easily loaded onto the holder by bringing its hole into approximate alignment with the spring coil 18 and pushing the workpiece rearwardly to engage edge portions of the hole in the undulations 27, at which point the tips of the stabilizing wings 19, 20 will also bear against the rear surface of the workpiece. It will be observed that a workpiece installed on the holder is firmly engaged by the holder at each of four spaced points and can thus have a very satisfactory electrical connection with the holder if such a connection is needed. The workpiece is of course unloaded from the holder by simply pulling it straight forward.

If the holder cooperates with an unapertured workpiece, so that opposite outer edge portions of the workpiece must be engaged in the undulations 27', the workpiece is moved forward around the stabilizing wing 19, 20 to engage one of those edge portions in the undulation 27' in the clamping arm 17 that carries the stabilizing wings, after which the other edge portion is swung forward into detent-like engagement with the undulation in the other clamping arm 16.

From the foregoing explanation taken with the accompanying drawings it will be apparent that this invention provides a very simple and inexpensive holder whereby workpieces can be attached to a carrier for transport through a station at which a coating operation is performed upon them, and that the holder of this invention can be very quickly loaded and unloaded but nevertheless maintains the workpiece in a predetermined attitude or orientation relative to the carrier, grips the workpiece securely, and is capable of providing a good electrical connection to it.

What is claimed as the invention is:

1. A workpiece holder which is detachably securable to a carrier and to which a workpiece to be coated is quickly and readily removably securable for transport by the carrier along a path that carries the workpiece through a coating station, said workpiece holder comprising:

a single piece of substantially stiff but springy wire having a pair of opposite ends, characterized in that:

A. a medial portion of said piece of wire is bent to define a pair of clamping arms connected by a spring coil, (1) said clamping arms and spring coil being substantially contained in a single plane, (2) each of said clamping arms having a front end adjacent to said spring coil and a rear end spaced rearwardly from the spring coil and spaced from the rear end of the other clamping arm, and (3) each of said clamping arms having an undulation intermediate its said ends, said undulations defining opposing concavities in which opposite edge portions of a workpiece are receivable for confinement of the workpiece under clamping bias imposed upon the clamping arms by the spring coil;

B. one end portion of said piece of wire is bent to define a loop connected to one of said clamping arms at the rear end thereof and substantially all portions of which are coplanar, said loop providing for attachment of the workpiece holder to a carrier with said one clamping arm projecting in a predetermined direction from the carrier; and C. the other end portion of said piece of wire is bent to define a pair of stabilizing wings each of which has an inner end and an outer end, the inner end of each stabilizing wing being adjacent to the rear end of the other of said clamping arms and the outer ends of the stabilizing wings being spaced to opposite sides of said plane and in forwardly offset relation to said rear end of said other clamping arm for engagement against rearwardly facing surface portions of a workpiece confined by said clamping arms, (1) one of said stabilizing wings being substantially U-shaped with a bight portion at its outer end and a pair of elongated legs which are connected by said bight portion, one of said legs being connected at its inner end to the rear end of said other clamping arm, and (2) the other of said stabilizing wings being connected at its inner end to the inner end of the other of said legs.

2. The workpiece holder of claim 1 in combination with a supporting member which is securable to a carrier and to which the workpiece holder is readily removably attached, said supporting member comprising:

(1) a body portion having a pair of opposite edges and a substantially flat forwardly facing surface between those edges, and (2) a pair of lugs, each projecting substantially forwardly from one of said edges and each having an aperture therethrough that is adjacent to said surface, said loop having opposite portions which project beyond said surface through said apertures and which have a close fit in said apertures whereby the remainder of said loop is confined against said surface.

3. A workpiece holder which is detachably securable to a carrier and to which a workpiece to be coated is quickly and readily removably securable for transport by the carrier along a path that carries the workpiece through a coating station, characterized in that:

said workpiece holder comprises a single piece of substantially stiff but springy wire having opposite ends, A. a medial portion of said piece of wire being bent to define (1) a spring coil, and (2) a pair of elongated clamping arms, each having a front end and a rear end, (a) said clamping arms being connected to said spring coil at their front ends, (b) said clamping arms and spring coil being substantially contained in a common plane, (c) said clamping arms extending rearward from said spring coil in divergent relation to one another to have their rear ends spaced to the rear of the spring coil and spaced from one another, and (d) each of said clamping arms having an undulation intermediate its ends, said undulations defining opposing concavities in which opposite edge portions of a workpiece are receivable for confinement of the workpiece under clamping bias imposed upon the clamping arms by the spring coil;

B. one end portion of said piece of wire being bent to define a U-shaped rear mounting portion of the workpiece holder having a pair of parallel legs connected by a bight portion, (1) said legs and bight portion being substantially contained in a second plane which is substantially normal to one of said clamping arms, and (2) one of said legs, at its end remote from said bight portion, being connected to the rear end of said one clamping arm; and C. the other end portion of said piece of wire being bent to define a pair of stabilizing wings, each of which has an inner end adjacent to the rear end of the other of said clamping arms and an outer end, (1) the outer ends of said stabilizing wings being spaced to opposite sides of said common plane and being in forwardly offset relation to the rear end of said other clamping arm for engagement against rearwardly facing surface portions of a workpiece confined by said clamping arms, (2) one of said stabilizing wings being in the form of a loop having adjacent ends, one of which is connected to the rear end of said other clamping arm and the other of which is connected to the inner end of the other stabilizing wing.

4. The workpiece holder of claim 3 wherein the other of said legs of said U-shaped rear mounting portion is longer than said one leg, in combination with a supporting member for detachably securing said clamping holder to a carrier, said supporting member comprising:

(1) a body having a substantially flat front surface and having (a) a length between a pair of opposite end edges which is less than the length of said one leg of said rear mounting portion and (b) a width transverse to its length which is at least as great as the distance between said legs of the rear mounting portion;

(2) a pair of lugs on said body, each projecting forwardly beyond said front surface from one of said edges, (a) one of said lugs defining a slot adjacent to said front surface and extending lengthwise therealong wherein said bight portion of the mounting portion is closely receivable, and (b) the other of said lugs defining a hole adjacent to said front surface wherein said other leg of the U-shaped mounting portion is closely receivable and which cooperates with said slot in confining said legs against said front surface; and (3) means on said body for securing the same to a carrier.

5. In combination, a workpiece holder to which a workpiece can be quickly and readily detachably secured for transport by a carrier along a defined path and a supporting member which is attached to the carrier and to which the workpiece holder is detachably secured, characterized by:

A. said supporting member comprising (1) a body having a substantially flat surface which faces in a forward direction and has a pair of opposite edges and (2) a pair of lugs on said body, each projecting substantially in said forward direction from one of said edges, (a) one of said lugs having therein a slot which is adjacent to said surface and extends lengthwise along the same, and (b) the other of said lugs having therein a hole adjacent to said surface; and B. said workpiece holder comprising a single piece of substantially stiff but springy wire having opposite ends, (1) a part of said piece of wire that extends along its length from one of its ends being bent to provide a U-shaped rear mounting portion of said holder having a pair of substantially parallel legs connected by a coplanar bight portion, (a) each of said legs overlying said surface along a substantial portion of its length and extending through said slot with a close fit to dispose said bight portion outwardly of one of said edges of the body, and (b) one of said legs being longer than the other, terminating at said one end of the piece of wire and extending through said hole with a close fit to have its terminal portion projecting beyond the other of said edges of the body;

(2) a medial portion of said piece of wire being bent to define (a) an elongated first clamping arm projecting substantially in said forward direction and having a rear end connected to said other of said legs at the end of the latter that is remote from said bight portion, (b) a spring coil connected to the front end of said first clamping arm, (c) a second elongated clamping arm having front and rear ends, said second clamping arm having its front end connected to the spring coil to be connected with the first clamping arm through the spring coil, said second clamping arm being contained in a plane that also substantially contains the spring coil and the first clamping arm and having its rear end spaced to the rear of the spring coil and spaced from the first clamping arm, and (d) an undulation in each of said clamping arms, intermediate the ends thereof, said undulations defining opposing concavities in the clamping arms in which opposite edge portions of a workpiece are receivable for confinement of the workpiece under clamping bias which the spring coil exerts upon the clamping arms; and (3) another part of said piece of wire, extending along its length from the other of its ends, being bent to define a pair of stabilizing wings, each having an inner end and an outer end, the inner ends of said stabilizing wings being adjacent to the rear end of said second clamping arm and the outer ends of said stabilizing wings being spaced to opposite sides of said plane and in forwardly offset relation to their inner ends to be engageable against spaced apart rearwardly facing surface portions of a workpiece confined by said clamping arms, (a) one of said stabilizing wings being substantially U-shaped with two legs that are connected by a bight portion at its outer end, one of the last-mentioned legs having an inner end connected to the rear end of the second clamping arm, and (b) the other stabilizing wing being connected at its inner end to the inner end of the other of the last-mentioned legs.

* * * * *